United States Patent [19]

Moghaddassi et al.

[11] Patent Number: 4,969,244

[45] Date of Patent: Nov. 13, 1990

[54] WARP BEAM DEPLETION MONITORING APPARATUS AND METHOD

[75] Inventors: Majid Moghaddassi, Greensboro; Arne Nielsen, Oak Ridge, both of N.C.

[73] Assignee: Guilford Mills, Inc., Greensboro, N.C.

[21] Appl. No.: 355,777

[22] Filed: May 23, 1989

[51] Int. Cl.[5] ..... D02H 13/08; B65H 63/00

[52] U.S. Cl. ..... 28/187; 19/0.23

[58] Field of Search ..... 19/0.2, 0.23; 28/185, 28/186, 187, 188, 189

[56] References Cited

U.S. PATENT DOCUMENTS

| | | | |
|---|---|---|---|
| 3,539,782 | 11/1970 | Upshur | 377/24 |
| 3,751,937 | 8/1973 | Bassist | 66/209 |
| 3,950,523 | 1/1976 | Garcia | 514/246 |
| 4,528,631 | 7/1985 | Bogucki-Land | 28/185 X |
| 4,707,887 | 11/1987 | Leifeld et al. | 19/0.2 |
| 4,853,679 | 8/1989 | Duda | 26/70 X |

*Primary Examiner*—Werner H. Schroeder
*Assistant Examiner*—Bradley Kurtz DeSandro
*Attorney, Agent, or Firm*—Shefte, Pinckney & Sawyer

[57] ABSTRACT

An apparatus and method is disclosed for monitoring depletion of yarn from a textile warp beam wherein yarn actually remaining on the beam is measured radially with respect to the beam, compared with a preselected radial dimension of yarn desired to remain on the beam when the machine is stopped for beam replacement, and machine operation is stopped when the measured radial dimension of yarn equals the predetermined radial dimension of yarn. An analog inductive proximity switch is supported at the periphery of yarn wound about the beam to measure the radial dimension between the switch and the beam by producing an electrical current output proportional to such dimension. A comparator circuit compares the switch output with a reference current selected to correspond to the current output of the switch when at the preselected radial dimension of yarn at which machine operation is to be stopped.

14 Claims, 4 Drawing Sheets

WARP BEAM DEPLETION MONITORING APPARATUS AND METHOD

BACKGROUND OF THE INVENTION

The present invention relates generally to textile warp knitting machines, weaving machines and other textile processing machines wherein yarn is wound about and supplied from a warp beam. More particularly, the present invention relates to a method and apparatus for monitoring the depletion of yarn wound about a warp supply beam for stopping operation of the associated textile processing machine in advance of full depletion of yarn from the beam.

In various textile fabric forming equipment, in particular warp knitting machines and weaving machines, yarn is supplied to the machine from one or more warp beams or spools about which a plurality of yarns are wound in side-by-side relation to be simultaneously fed to the machine by beam rotation synchronously with the rate of production of the associated machine. As is widely appreciated within the textile industry, a warp beam of this type should not be permitted to fully deplete whereby the trailing ends of the yarns would be lost into the associated machine, disadvantageously terminating its continuous operation, requiring re-setup of the machine, and in many cases presenting a significant risk of damage to the yarn manipulating instrumentalities of the machine due to continuing machine operation without a supply of yarn.

Accordingly, conventional practice is to stop operation of the textile machine shortly in advance of full warp beam depletion, for replacement of the depleted beam with a full warp beam. Conventionally, the determination of when to stop the machine for exchange of a depleted warp beam is made by a machine operator merely by visually monitoring the gradual depletion of yarn from the beam. As will be readily understood, this technique is inherently inexact. Since all warp yarn remaining on the depleted warp beam when taken out of service is discarded as waste, it is of course desirable to allow the beam to deplete as much as possible before replacement. On the other hand, since the overriding concern in all cases is to avoid complete depletion of yarn from the beam, an operator must exercise caution and good judgment, a high yarn waste factor resulting from premature beam replacement being substantially less disadvantageous than the aforementioned problems resulting from complete depletion of the beam. Proper exercise of the operator's judgment is a particularly difficult problem with machines which operate at relatively high warp yarn feeding rates, such as conventional warp knitting machines, so that the yarn waste factor in the operation of such machines is often relatively high.

U.S. Pat. No. 3,751,937 discloses a means of automatically detecting the depletion of a warp beam in a textile warp knitting machine. According to this patent, a strip of adhesive tape is secured transversely across several of the warp yarns on a warp beam at a location near the yarn ends when first wound onto the beam. An associated sensor is provided for detecting the tape as the warp beam is depleted to thereby sense the impending exhaustion of the beam. A switch is operated in response to the sensor to terminate operation of the machine when the sensor detects the tape. While this invention offers advantages over the conventional technique aforedescribed of an operator manually stopping the machine based upon a visual monitoring of the warp beam, the invention is also disadvantageous in that it requires special steps in the original preparation of the warp beam and the adhesive from the tape may deleteriously affect the yarns to which the tape is adhered. It is unknown whether this invention has achieved any reasonable degree of commercial acceptance and use.

SUMMARY OF THE INVENTION

It is accordingly an object of the present invention to provide an apparatus and method by which the depletion of yarn from a textile warp supply beam may be monitored and the associated textile processing machine automatically stopped at a predetermined point in advance of the complete depletion of the warp beam.

Briefly summarized, the depletion of yarn wound about a warp supply beam in a textile processing machine, such as a warp knitting machine, is monitored according to the method and apparatus of the present invention utilizing a suitable means which measures, in a direction radially with respect to the beam, an actual radial dimension of yarn remaining on the beam during operation of the textile processing machine. A selected radial dimension of yarn to remain on the beam when operation of the textile processing machine is to be stopped for replacement of the beam is predetermined by a selector means. Another means, associated with the measuring and selector means, compares the measured actual radial dimension of yarn with the predetermined selected radial dimension of yarn. When the yarn on the beam has depleted to a point at which the measured actual radial dimension of yarn equals the predetermined radial dimension of yarn, the operation of the textile processing machine is stopped through another suitable means associated with the comparison means.

In the preferred embodiment of the present method and apparatus, an analog inductive proximity switch is utilized as the measuring means and is operative for producing an electrical current output which is directly proportional to the measured actual radial dimension of yarn on the beam. Likewise, the selector means operates by producing a fixed electrical current output which corresponds to the selected radial dimension of yarn, with the comparison means operating to compare the respective outputs. The proximity switch is supported at the periphery of the yarn wound about the beam for measuring the distance between the switch and the beam, the switch being supported by an arm assembly which adjustably positions the switch in radial relation to the beam at all radial dimensions of the yarn remaining on the beam. In textile processing machinery conventionally equipped with a device engaged with the periphery of yarn wound on the beam, such as a signal arm in a warp knitting machine adapted for continuosly determining the peripheral surface speed of the beam, the arm assembly for the proximity switch is mounted to the signal arm or other beam-engaging device. Preferably, the measurement of the actual radial dimension of yarn on the beam and the comparison thereof with the predetermined selected radial dimension of yarn are carried out continuously during the operation of the textile processing machine. Each of the measured radial yarn dimension and the predetermined selected radial yarn dimension may be displayed for visual monitoring by a machine operator.

DESCRIPTION OF THE PREFERRED EMBODIMENT

Figure 1:
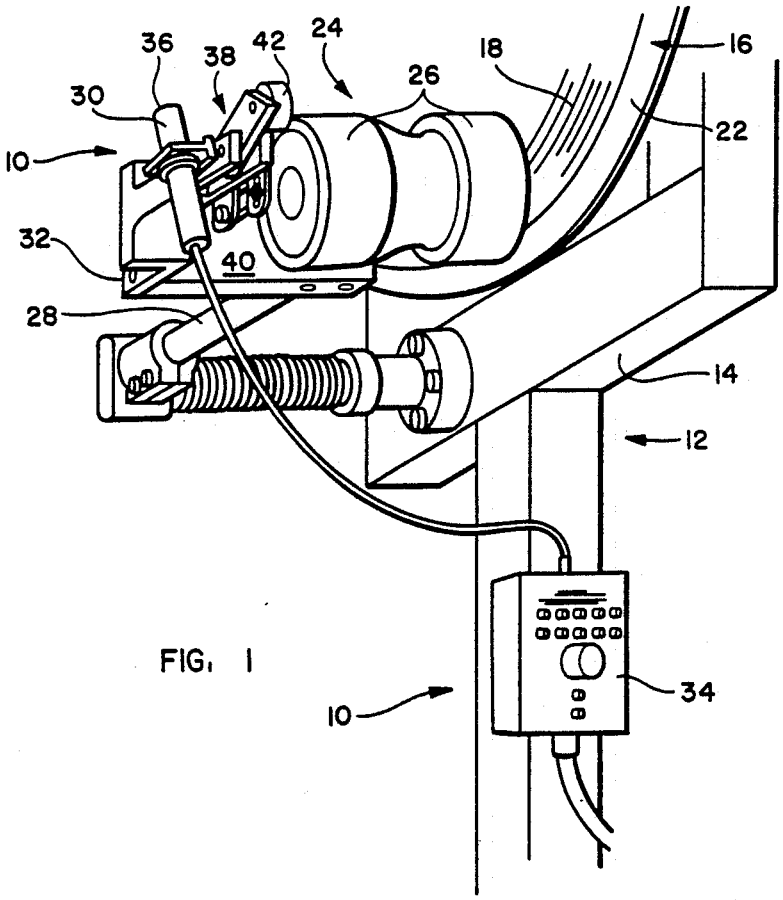
FIG. 1 is a perspective view of a warp beam depletion monitoring apparatus according to the preferred embodiment of the present invention.

Referring now to the accompanying drawings and initially to FIG. 1, a warp beam depletion monitoring apparatus according to the present invention is shown generally at 10 as preferably embodied for use in a conventional textile warp knitting machine, indicated generally at 12. The warp knitting machine 12 is of a typical known construction having, in pertinent part, a machine frame 14 which supports rotatably one or more driven warp beams 16 for supplying warp yarns 18 for positive feeding to a knitting arrangement of one or more yarn guide and needle bars (not shown). As is known, each warp beam 16 is constructed in the form of a spool having a central longitudinally-extending axial shaft 20 (FIGS. 2 and 3) with a pair of radial flanges 22 affixed at opposite respective ends of the shaft 20. A plurality of warp yarns are wound circumferentially about the beam shaft 20 in side-by-side relation along the length of the shaft 20 between the flanges 22, the yarns 18 being fed simultaneously to the knitting machine 12 in side-by-side relation in the form of a planar sheet. As the yarns 18 gradually deplete from the warp beam 16, the beam 16 is driven at its shaft 20 at a gradually increasing axial speed so that the surface speed of the yarns 18 at the outer periphery of the beam 16 is substantially constant. For this purpose, the knitting machine 12 includes a speed monitoring device 24 having an arm 28 pivotably mounted on the frame 14 of the knitting machine 12 and a pair of rollers 26 supported by the arm 28 in peripheral surface contact with the yarns 18 on the warp beam 16 to continuously determine the peripheral surface speed of the yarns 18 on the warp beam 16 for control of the driven speed of the beam 16 in relation thereto, all as is conventional. The depletion monitoring apparatus 10 basically includes a sensor 30 mounted on the arm 28 by a sub-arm assembly 32 and operatively connected to an associated electrical control system (FIGS. 4–6) housed in a control box 34 mounted on the machine frame 14.

The sensor 30 is an analog inductive proximity switch having an internal electrical coil operable at relatively high frequency to transmit a magnetic field a predetermined distance from a sensing face 36 at one end of the sensor 30. As is known, when a metallic object is present within the electrical field, the metallic object absorbs a portion of the magnetic field in inverse relation to the distance of the metallic object from the sensing face. The sensor 30 is equipped with electronic control circuitry which is operative to measure the magnetic field to determine the amount thereof absorbed by the metallic object and, in turn, to produce an output flow of electrical current in direct proportion thereto. In this manner, the electrical current output of the sensor is directly representative of, and proportional to, the distance of the metallic object from the sensing face 36 of the sensor 30. Analog inductive proximity switches of this type are known, several representative examples of such switches being manufactured by La Telemecanique Electrique S.A., of Nanterre, France.

Figure 2:
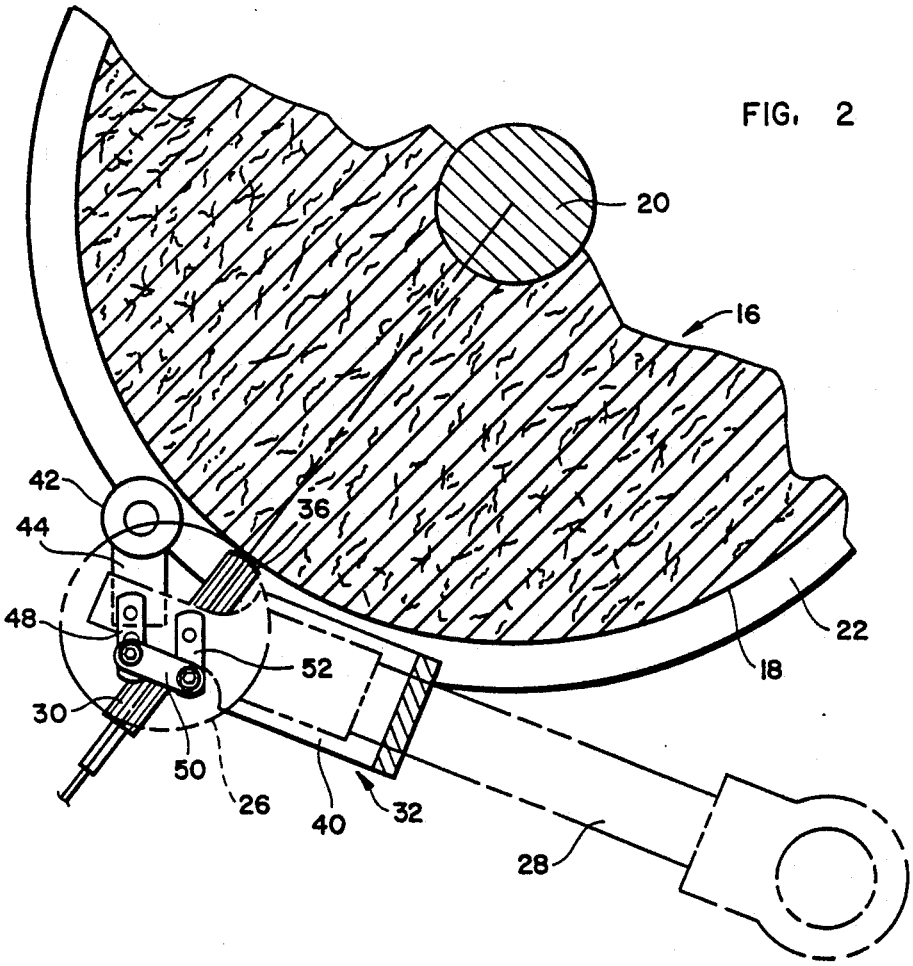
FIG. 2 is a right side elevational view of the depletion monitoring apparatus of FIG. 1.
Figure 3:
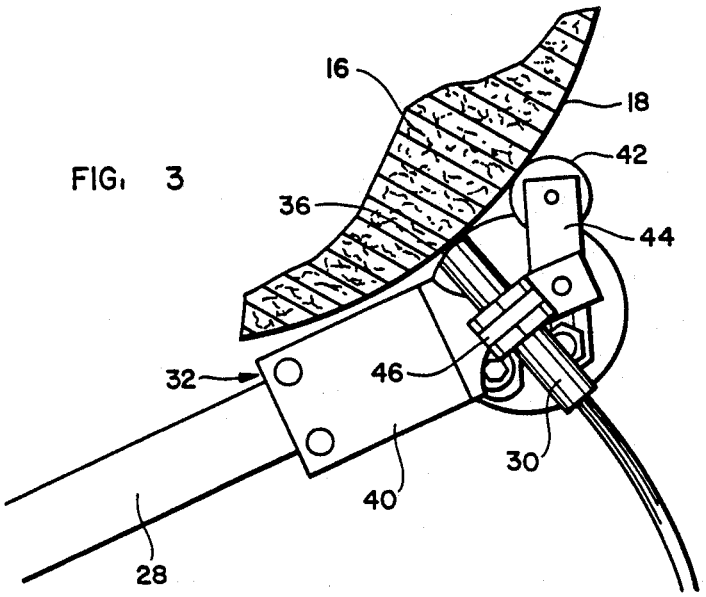
FIG. 3 is a left side elevational view of the depletion monitoring apparatus of FIG. 1.

As best seen in FIGS. 2 and 3, the sub-arm assembly 32 supports the sensor 30 with its sensing face 36 in contact or near contact with the peripheral surface of the yarns 18 wound about the warp beam 16 in radial relation to the warp beam 16, i.e. with the sensing face 36 tangential to the outer peripheral surface of the yarns 18. Since virtually all conventional warp beams 16 are fabricated of steel or another metal, the sensor 30 is thusly disposed by the sub-arm assembly 32 to produce an electrical current output which is directly proportional to the distance between the sensing face 36 and the axial shaft 20 of the warp beam 16, thereby proportionally representing the actual dimension of the yarns 18 remaining on the beam 16 measured in a direction radially with respect to the beam 16, when the beam shaft 20 is within the magnetic field of the sensor 30.

As will be understood, the sensing face 36 of the sensor 30 follows an arcuate path as the yarns 18 deplete from the warp beam 16. If the arcuate path of movement of the sensing face 36 is arranged so as to intersect the rotational axis of the beam 16, the sensing face 36 will remain in proper radial relation to the beam 16 throughout the arcuate path of movement. On the other hand, this may not be practical or possible in some cases. For example, as representatively illustrated in FIGS. 1–3, the supporting arm 28 for the speed monitoring device 24 does not define an arcuate path of movement for the speed monitoring device 24 intersecting the beam axis and, in turn, the sensing face 36 of the sensor 30 as supported by the sub-arm assembly 32 from the arm 28 also does not move in an arcuate path intersecting the beam axis.

Accordingly, the sub-arm assembly 32 is provided with a pivoted follower assembly 38 on which the sensor 30 is mounted to automatically adjust the relationship of the sensing face 36 throughout the arcuate path of movement of the sensor 30 as the yarns 18 are depleted from the beam 16 so as to maintain the sensing face 36 in proper radial relation to the beam shaft 20. Specifically, as best seen in FIGS. 2 and 3, the sub-arm assembly 32 includes a L-shaped main arm 40 rigidly fixed to the arm 28 of the speed monitoring device 24, with the follower assembly 38 being supported at the outward free end of the main arm 40. The follower assembly 38 includes a follower roller 42 rotatably mounted on a lever arm 44 pivoted to the outward free end of the main arm 40. The sensor 30 is mounted adjacent the free end of the main arm 40 on a support plate 46 pivotably affixed to, and extending laterally outwardly from, one side of the main arm 40. The respective pivot shafts of the follower roller lever arm 44 and the sensor support plate 46 are connected by a series of three connecting links 48, 50, 52 at the opposite lateral side of the main arm 40. One end of the connecting link 48 is fixed to the pivot shaft of the follower roller lever arm 44 and, similarly, one end of the connecting link 52 is fixed to the pivot shaft of the sensor support plate 46, the respective opposite ends of the connecting links 48, 52 being pivotably attached to opposite ends of the intermediate connecting link 50.

In this manner, pivotal movement of the follower roller support arm 44 actuates corresponding pivotal movement of the support plate 46 and, in turn, the sensor 30 thereon. The follower roller 42 is biased, in a manner not shown, to ride in surface engagement on the outer periphery of the yarns 18 on the warp beam 16. As the yarns 18 are depleted from the warp beam 16 so that the effective diameter thereof progressively reduces, the pivotal disposition of the follower roller support arm 44 gradually changes with respect to the fixed main arm 40 and, in turn, correspondingly changes the pivoted orientation of the support plate 46 and the sensor 30 with respect to the main arm 40. The orientation of the follower roller lever arm 44 and the sensor support plate 46 relative to one another is set by the connecting links 48, 50, 52 so that the sensing face 36 of the sensor 30 is maintained in radial facing relationship to the warp beam shaft 20, i.e. tangentially to the outer periphery of the yarns 18, throughout the full range of arcuate movement of the follower roller 42 over the course of depletion of the warp beam 16.

Figure 4:
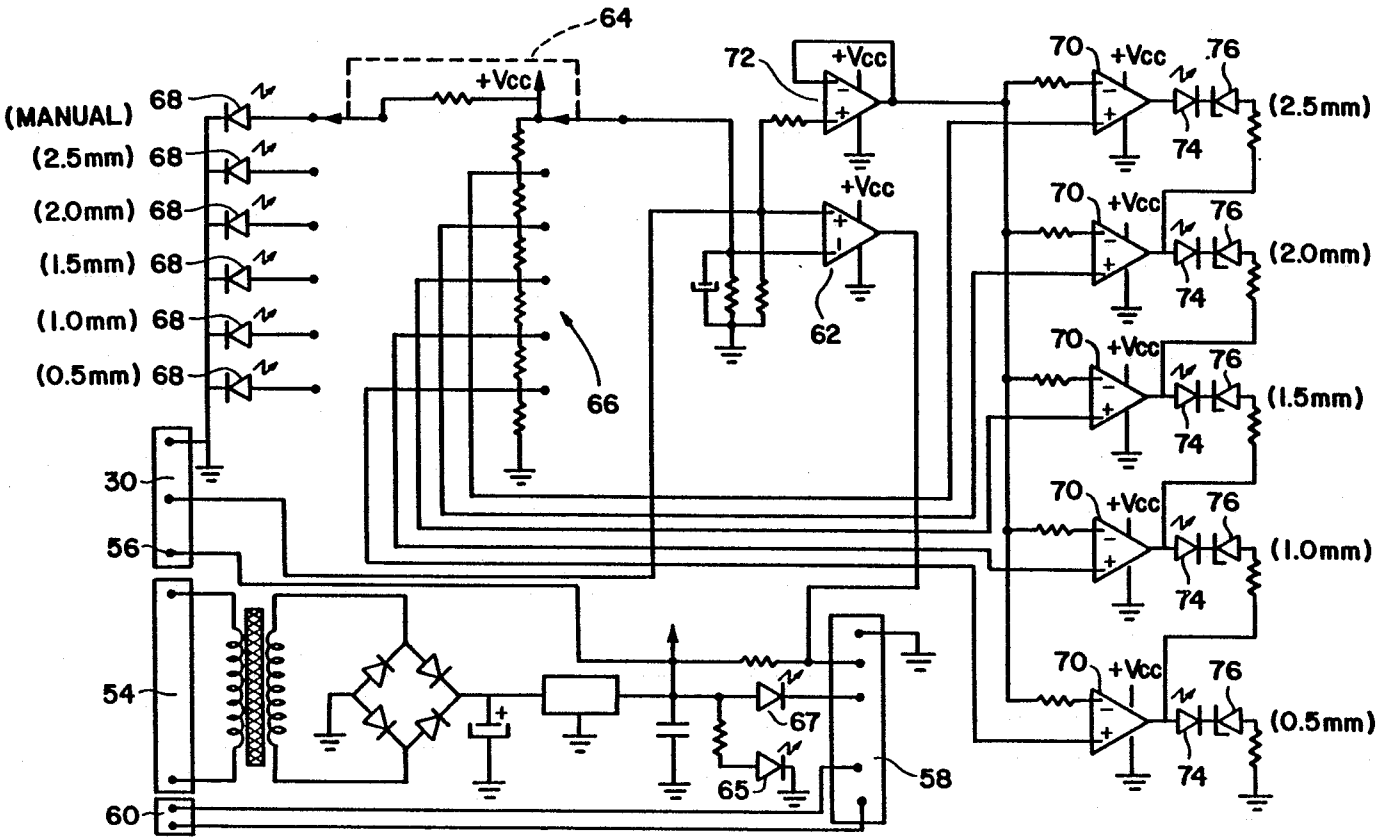
FIG. 4 is a schematic diagram of the electrical components and circuitry for the present depletion monitoring apparatus.

As aforementioned, the sensor 30 is electrically connected in an operating electrical control circuit, shown in FIG. 4. The control circuit is connected at 54 to a suitable source of electrical power and, in turn, supplies electrical operating current to the sensor 30 at 56. The circuit includes a so-called opto-isolator 58, a solid state relay, two terminals of which are connected in series in the electrical power supply to the warp knitting machine 12, as indicated at 60. The variable electrical current output of the sensor 30 is delivered to the positive input terminal of a comparator 62, preferably an operational amplifier, the output of which is connected to the opto-isolator 58. The negative input terminal of the comparator 62 is selectively connectable through a manually-operable gang switch 64 at intermediate points in a chain of resistors indicated at 66, each of which is selected to have a different resistance to correspond to the current output produced by the sensor 30 at different increments of distance between its sensing face 36 and the warp beam shaft 20. By way of example, the resistors 66 in the circuit shown in FIG. 4 are selected in correspondence to sensor outputs ranging from a 0.5 millimeter spacing to a 2.5 millimeter spacing from the beam shaft 20 in 0.5 millimeter increments, although those persons skilled in the art will recognize that a suitable chain of resistors 66 may be selected to correspond to any desired spacing increment and number thereof. Thus, the gang switch 64 serves to select and deliver to the negative terminal of the comparator 62 a reference current corresponding to a radial spacing from the beam shaft 20 determined by the resistor chain 66. The gang switch 64 is also similarly connectable to alternately energize one of a series of light emitting diodes (LEDs), indicated at 68, which are connected in parallel with the sensor 30, each LED 68 corresponding to a respective one of the spacing increments represented by the several resistors 66.

The comparator 62 is operable in conventional manner to produce an output electrical current whenever the input to its positive terminal exceeds the input to its negative terminal and, in turn, the output current is operative to energize the opto-isolator 58 so as to complete the power supply circuit of the knitting machine. Thus, since as aforementioned the electrical current output of the sensor 30 is directly proportional to the distance between its sensing face 36 and the warp beam shaft 20, the comparator 62 maintains the opto-isolator 58 energized and, in turn, the knitting machine 12 operational for so long as a sufficient quantity of the yarns 18 remains on the warp beam 16 that the radial dimension of the yarns 18 exceeds the dimension represented by the resistor chain 66 at the selected setting of the gang switch 64. However, once the yarns 18 on the beam 16 have been depleted beyond that point, the output current of the sensor 30 will fall below the reference current permitted to flow through the resistor chain 66, whereupon the reference current delivered through the resistor chain 66 to the negative input terminal of the comparator 62 exceeds the output current of the sensor 30 applied to the positive input terminal of the comparator 62 to terminate the output current of the comparator 62 and, in turn, deenergize the opto-isolator 58 and open the power supply circuit to the knitting machine 12 thereby stopping its operation.

A "power-on" LED 65 is provided in the power supply circuit to be energized whenever electrical power is being supplied to the control circuit to indicate whether the present monitoring apparatus is operational. A "machine stop-run" LED 67 is also provided in the power supply circuit to be energized whenever electrical current is being supplied through the opto-isolator 58 to the knitting machine 12 to indicate whether the machine is running or is stopped.

As will thus be understood, the radial dimensions represented by the resistor chain 66 which may be selected using the gang switch 64 are predetermined to correspond to the quantity of the yarns 18 remaining on the beam 16 at which it may be desirable under normal circumstances to stop operation of the knitting machine 12 in advance of full depletion of the beam 16. As will be further understood by those persons skilled in the art, the radial dimension to be selected may vary from one knitting operation to another depending upon any one or more of a variety of factors, including but not limited to the speed of machine operation and the corresponding rate of yarn feed from the warp beam 16, the count or denier of the yarns 18, the yarn type, etc. For this reason, the control circuit provides at least several possible radial dimensions for selection by the gang switch 64 to accommodate application of the present depletion monitoring apparatus in a wide variety of possible applications.

In addition to the above-described capability of the control circuit for stopping operation of the knitting machine 12 when the yarns 18 are depleted to one of the preselected radial yarn dimensions, the control circuit also includes an arrangement for displaying incrementally the decreasing radial dimension of the yarns 18 within the full dimensional range determined by the resistor chain 66. For this purpose, a series of secondary comparators 70 are provided, each comparator 70 having its negative input terminal connected through a buffer 72 to the sensor 30 to receive its output current and each comparator 70 having its positive terminal connected to a respective one of the intermediate points in the resistor chain 66. In this manner, each comparator 70 represents one of the predetermined increments of dimension represented by the resistors 66, the positive input terminal of each comparator 70 receiving a different reference current corresponding to the respective reference current established by the resistor chain 66 at the point at which the respective comparator 70 is connected in the chain. Each comparator 70 has its output terminal connected in series with a respective LED 74 and a Zener diode 76, the input terminal to each LED 74 being connected to the output of each Zener diode 76 associated with the comparator 70 representing the next greater dimension increment.

In this manner, for so long as the yarns 18 on the warp beam 16 have a radial dimension greater than the dimensional range represented by the resistor chain 66, the sensor output current applied to the negative input terminal of each comparator 70 exceeds the respective current supplied to the positive input terminal of each comparator 70, whereby none of the comparators 70 produce an output current and, in turn, each LED 74 is deenergized. Once the yarns 18 have depleted from the warp beam 16 to decrease their radial dimension to within the dimension range represented by the resistor chain 66, the output current from the sensor 30 decreases to a value less than the reference current representing the greatest increment of dimension, e.g. 2.5 millimeters, whereupon the reference current applied to its positive input terminal exceeds the sensor output current applied to its negative input terminal to produce an output current from the comparator 70 to energize and illuminate its associated LED 74. As the yarns 18 further deplete to the radial dimension of the next smaller increment, e.g. 2.0 millimeters, the respective comparator 70 likewise becomes operative to produce an output current to energize its associated LED 74, while at the same time the comparator output is applied to the Zener diode 76 associated with the previously-operable comparator 70 thereby eliminating any voltage difference across the previously-operable comparator 70 to deactuate it and deenergize its associated previously-energized LED 74. This operation continues as the warp beam 16 continues to deplete, until the beam is depleted to a radial dimension of the yarns 18 equal to or less than the radial dimension represented by the selected setting of the gang switch 64, whereupon the knitting machine 12 is deactuated as aforedescribed.

Figure 5:
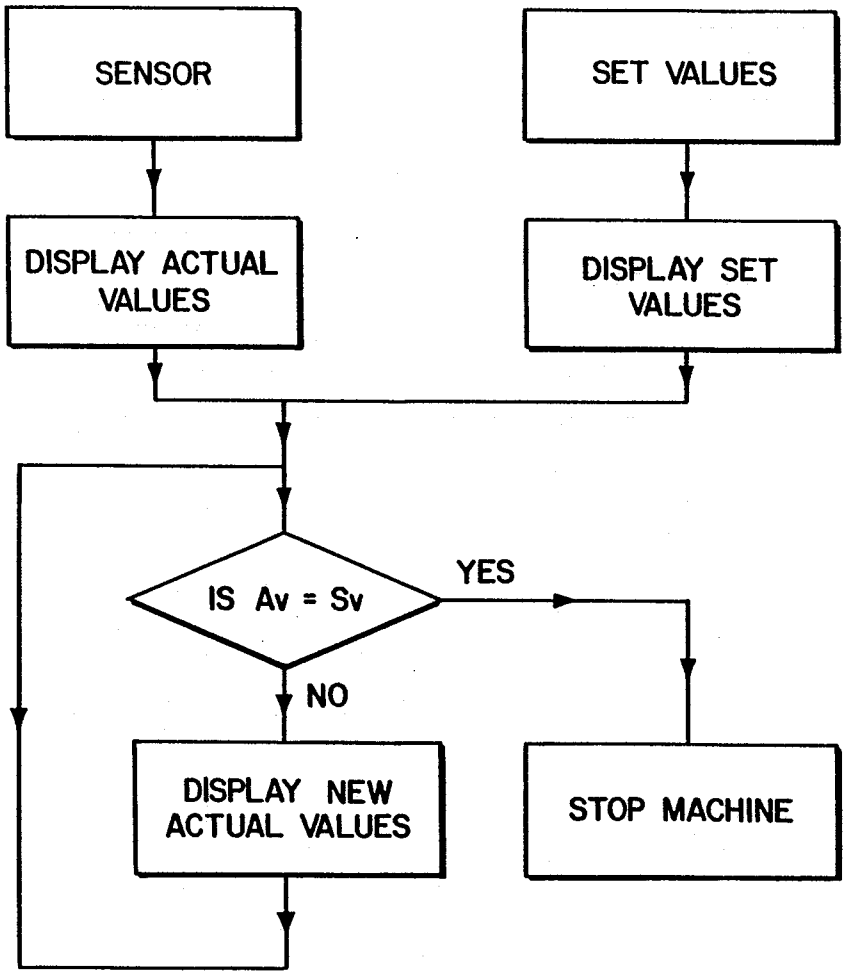
FIG. 5 is a block diagram illustrating the logic cycles carried out by the present depletion monitoring apparatus.

The logic design of the operating control circuit will thus be understood to be as illustrated diagrammatically in FIG. 5. The setting of the gang switch 64 to determine the selected radial dimension of the yarns 18 to remain on the warp beam 16 when the knitting machine 12 is stopped initially results in the energization and illumination of the corresponding LED 68. As the warp beam 16 is gradually depleted of the yarns 18, the actual radial dimension of the yarns 18 remaining on the warp beam 16, as represented by the current output of the sensor 30, is continuously compared with the predetermined radial dimension. When the yarns on the beam have depleted to within the dimensional range of selectable radial dimensions of the yarns 18, the actual radial dimension of yarn remaining on the warp beam is displayed by sequential illumination of the LEDs 74, until the actual radial dimension of yarn remaining on the beam 16 equals the radial dimension preselected by the gang switch 64, whereupon the associated knitting machine 12 is stopped.

A so-called "manual" setting of the gang switch 64 is also provided to supply a reference current to the negative terminal of the comparator 62 which is less than the minimum current output of which the sensor 30 is capable, thereby to maintain the output current of the comparator 62 without regard to the radial dimension of yarn remaining on the beam 16. However, the depletion monitoring apparatus 10 continues its display function to illuminate the LEDs 74 in sequence as the yarn on the beam 16 depletes. This setting thus allows the knitting machine operator to visually monitor depletion of the beam 16 with the aid of the display LEDs 74 and to manually stop operation of the knitting machine 12 when the operator determines it necessary or desirable.

Figure 6:
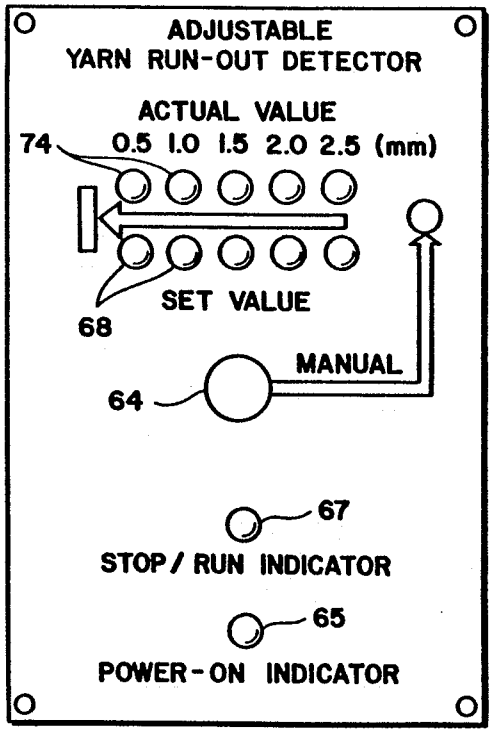
FIG. 6 is a front elevational view of the control panel for the present depletion monitoring apparatus.

For convenient reference and access by an operator of the knitting machine 12, the gang switch 64, the power-on LED 65, the machine stop-run LED 67, the selector LEDs 68, and the yarn measurement LEDs 74 are mounted on the front panel of the control box 34 within which the electrical control circuit is housed, as illustrated in FIG. 6.

The advantages of the depletion monitoring apparatus and method of the present invention may thus be understood. Most importantly, the present invention eliminates the conventional practice of manually stopping a warp knitting machine or other textile processing machine utilizing a warp yarn supply beam based upon the inherent inaccuracy of a visual monitoring of warp beam depletion by a machine operator. Instead, the present invention allows a machine operator to reliably program the machine in advance to stop at a predetermined point in its operation shortly in advance of complete depletion of the warp yarns from the beam. As such, the amount of yarn which will remain on a depleted warp beam when taken out of service may be controlled with accuracy and, in turn, the amount of warp yarns which must be discarded as waste may be carefully regulated and substantially reduced in comparison to yarn waste under conventional practice. Potentially dramatic savings in yarn cost may therefore be realized.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. For example, although the present warp beam depletion monitoring apparatus is herein described and illustrated in an embodiment utilizing an analog control circuit, it will be apparent that, alternatively, a microprocessor or other digital control may be utilized with equal or greater effectiveness and flexibility. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. Apparatus for monitoring depletion of yarn wound about a warp supply beam in a textile processing machine, comprising means for measuring in a direction radially with respect to the beam an actual radial dimension of yarn remaining on the beam during operation of the textile processing machine, said measuring means including means for sensing the beam from a location at the periphery of the yarn wound about the beam and means associated with said beam sensing means for determining the distance between the sensing means and the beam, means for predetermining a selected radial dimension of yarn remaining on the beam at which operation of the textile processing machine is to be stopped for replacement of the beam, means for comparing the actual radial dimension of yarn with the selected radial dimension of yarn, and means associated with the textile processing machine for stopping operation thereof when the actual radial dimension of yarn equals the selected radial dimension of yarn.

2. Apparatus for monitoring depletion of yarn wound about a warp supply beam in a textile processing machine according to claim 1 and characterized further by means for supporting the sensing means at the periphery of the yarn wound about the beam.

3. Apparatus for monitoring depletion of yarn wound about a warp supply beam in a textile processing machine according to claim 1 or 2 and characterized further in that the measuring means is operative for producing an electrical current output which is directly proportional to the measured actual radial dimension of yarn, the predetermining means is operative for producing a fixed electrical current output which corresponds to the selected radial dimension of yarn, and the comparing means is operative to compare the output of the measuring means with the output of the predetermining means.

4. Apparatus for monitoring depletion of yarn wound about a warp supply beam in a textile processing machine according to claim 3 and characterized further in that the measuring means comprises an analog inductive proximity switch.

5. Apparatus for monitoring depletion of yarn wound about a warp supply beam in a textile processing machine according to claim 2 and characterized further in that the supporting means comprises arm means for adjustably positioning the sensing means in radial relation to the beam at all radial dimensions of the yarn on the beam.

6. Apparatus for monitoring depletion of yarn wound about a warp supply beam in a textile processing machine according to claim 2 and characterized further in that the textile processing machine includes means engaged with the periphery of yarn wound on the beam throughout the operation of the textile processing machine for continuously determining the peripheral surface speed of the beam, the supporting means including means for mounting the sensing means to the speed determining means.

7. Apparatus for monitoring depletion of yarn wound about a warp supply beam in a textile processing machine according to claim 1 and characterized further by means for displaying the measured radial dimension of yarn and the selected radial dimension of yarn.

8. Apparatus for monitoring depletion of yarn wound about a warp supply beam in a textile processing machine according to claim 1 and characterized further in that the measuring means and the comparing means are operative continuously during the operation of the textile processing machine.

9. A method of monitoring depletion of yarn wound about a warp supply beam in a textile processing machine, comprising the steps of measuring in a direction radially with respect to the beam an actual radial dimension of yarn remaining on the beam during operation of the textile processing machine, said measuring including sensing the beam from a location at the periphery of the yarn wound about the beam and determining the distance between the sensing location and the beam, predetermining a selected radial dimension of yarn remaining on the beam at which operation of the textile processing machine is to be stopped for replacement of the beam, comparing the actual radial dimension of yarn with the selected radial dimension of yarn, and stopping operation of the textile processing machine when the actual radial dimension of yarn equals the selected radial dimension of yarn.

10. A method of monitoring depletion of yarn wound about a warp supply beam in a textile processing machine according to claim 9 and characterized further in that said measuring step comprises positioning a sensing means at the periphery of the yarn wound about the beam and measuring the distance between the sensing means and the beam.

11. A method of monitoring depletion of yarn wound about a warp supply beam in a textile processing machine according to claim 9 or 10 and characterized further in that said measuring step comprises producing an electrical current output which is directly proportional to the measured actual radial dimension of yarn, said predetermining step comprises producing a fixed electrical current output which corresponds to the selected radial dimension of yarn, and said comparing step comprises comparing the outputs.

12. A method of monitoring depletion of yarn wound about a warp supply beam in a textile processing machine according to claim 11 and characterized further in that said measuring includes inductively sensing the proximity of the beam to the periphery of the yarn wound thereabout.

13. A method of monitoring depletion of yarn wound about a warp supply beam in a textile processing machine according to claim 10 and characterized further by adjustably maintaining the sensing means in radial relation to the beam at all radial dimensions of the yarn on the beam.

14. A method of monitoring depletion of yarn wound about a warp supply beam in a textile processing machine according to claim 9 and characterized further by displaying the measured radial dimension of yarn and the selected radial dimension of yarn.

* * * * *